US009090443B1

(12) United States Patent
Malinski

(10) Patent No.: US 9,090,443 B1
(45) Date of Patent: Jul. 28, 2015

(54) WINE STORAGE AND DISPENSING APPARATUS

(71) Applicant: Jon M. Malinski, Paradise Valley, AZ (US)

(72) Inventor: Jon M. Malinski, Paradise Valley, AZ (US)

(73) Assignee: Vinocopia, Inc., Richfield, MN (US)

( * ) Notice: Subject to any disclaimer, the term of this patent is extended or adjusted under 35 U.S.C. 154(b) by 0 days.

(21) Appl. No.: 14/208,522

(22) Filed: Mar. 13, 2014

(51) Int. Cl.
*B67D 3/00* (2006.01)

(52) U.S. Cl.
CPC ..... *B67D 3/0067* (2013.01); *B67D 3/0087* (2013.01)

(58) Field of Classification Search
CPC ..... B65D 77/06–77/068; B67D 2001/0827; B67D 3/00; B67D 3/0029; B67D 3/0067; B67D 3/0083; B67D 3/0087
USPC ..... 222/105, 131, 183, 185.1, 325; 220/4.08, 4.09, 4.04, 4.05
See application file for complete search history.

(56) References Cited

U.S. PATENT DOCUMENTS

| | | | | | |
|---|---|---|---|---|---|
| 2,058,027 | A | | 10/1936 | Martinet | |
| 2,116,622 | A | | 5/1938 | Eisenmenger | |
| 3,112,047 | A | * | 11/1963 | Weinreich et al. | 222/105 |
| 3,191,810 | A | * | 6/1965 | Johnston | 222/183 |
| 3,198,390 | A | * | 8/1965 | Beckman et al. | 222/105 |
| 3,221,943 | A | * | 12/1965 | Anderson | 222/183 |
| 3,239,104 | A | * | 3/1966 | Scholle | 222/81 |
| 3,325,058 | A | | 6/1967 | West, Jr. | |
| 3,696,969 | A | | 10/1972 | De Van et al. | |
| 4,304,341 | A | | 12/1981 | Shirley | |
| 4,673,125 | A | * | 6/1987 | Weaver | 229/122.2 |
| 4,812,054 | A | | 3/1989 | Kirkendall | |
| 5,042,682 | A | * | 8/1991 | Ritter et al. | 229/117.3 |
| 6,334,329 | B1 | | 1/2002 | Weller | |
| 6,561,386 | B1 | | 5/2003 | Martens | |
| 6,827,237 | B2 | * | 12/2004 | Yorn et al. | 222/105 |
| 7,434,705 | B2 | | 10/2008 | Evangelista | |
| 8,596,496 | B2 | | 12/2013 | Malinski | |
| 2004/0188463 | A1 | * | 9/2004 | Harris, Jr. | 222/105 |
| 2008/0087682 | A1 | | 4/2008 | Overgaard | |
| 2009/0250489 | A1 | | 10/2009 | Saunders et al. | |
| 2012/0018450 | A1 | * | 1/2012 | Malinski | 222/105 |

FOREIGN PATENT DOCUMENTS

| | | | |
|---|---|---|---|
| JP | 2007-091334 | A | 4/2007 |

* cited by examiner

*Primary Examiner* — Daniel R Shearer
*Assistant Examiner* — Nicholas J Weiss
(74) *Attorney, Agent, or Firm* — DuFault Law Firm, P.C.; Dustin R. DuFault

(57) ABSTRACT

An apparatus for dispensing pre-packaged wine comprises a housing configured substantially in the shape of a wine barrel. A shelf positioned within the barrel extends from a front face toward a removable back panel. A shelf support for supporting the shelf includes a semi-circular contour for engaging a lower portion of the circumferential wall. A wine insert, supportable by the shelf, is disposable within the housing with the back panel removed. The wine insert includes a floor having a declined portion allowing wine contained therein to be drawn by gravity towards the rear of the housing. A spigot and conduit fluidly connected to the wine insert are provided for selectively dispensing the wine.

4 Claims, 7 Drawing Sheets

WINE STORAGE AND DISPENSING APPARATUS

CROSS-REFERENCE TO RELATED APPLICATION(S)

None.

BACKGROUND OF THE INVENTION

The present invention generally relates to wine storage devices. More particularly, the present invention relates to an apparatus for storing and dispensing wine from collapsible, reusable containers.

For many years, wine has remained one of the most popular drinks to accompany a meal, and as such, is made available not only at home, but at a vast number of restaurants. It is therefore important for a restaurant to keep in stock ample quantities of wine to meet the demand of its customers. However, as wine has historically been stored within glass 750-mL bottles, not only are there increased shipping costs associated with the use of glass bottles, but stocking a restaurant with such wine requires certain space requirements. Alternatively, certain types of wine have been made available by means of portable fluid containers, for example flexible 3- to 10-liter bladders of wine contained within a cardboard box, sometimes referred to as "wine-in-a-box" or simply "box wine". While such containers cut down on shipping costs, there are still storage considerations to take into account, as well as other inherent setbacks. For instance, as the box itself must be placed within a refrigeration unit to keep the wine chilled, the refrigeration space required for the box must be considered. Further, and regardless if a bottle or portable fluid bladder is used, once opened, the shelf-life of the wine decreases rapidly due to oxidation. While bottles of wine typically have to be consumed within a day or so, "wine-in-a-box" products currently available typically last only about a week. More importantly, though, as wine is considered by many to be a premium product, "wine-in-a-box" does not do well from a marketing standpoint as it has been perceived by the purchasing public to be an inferior product or inferior means of storage as opposed to glass bottles. For this reason alone, many vintners have avoided providing wines in this fashion, preferring instead to stick with glass bottles.

There exist in the art several examples of devices that have attempted to provide a means for storing box wine in an aesthetically pleasing manner. However, limitations exist in such examples as conventional devices have been shown to be quite difficult to change between spent wine bladders and new ones. Recent improvements in the art have made it less difficult to change spent wine bladders. For example, commonly owned U.S. Pat. No. 8,596,496 describes a rear-loading wine storage and dispensing device that overcame some of these problems. However, other complications have since risen including ease of installing a support floor for the insert. Another complication that has been known for quite some time is the difficulty in extracting all the wine from these types of inserts without having to physically manipulate the insert or device.

Currently, there exists a need in the art to provide an aesthetically pleasing wine dispensing mechanism for use in conjunction with reusable wine inserts which provides a stable support floor for the inserts and which is not difficult to construct. There also exists a need in the art to provide a wine insert that is capable of dispensing the entirety of its contents without the aid of physical manipulation.

BRIEF SUMMARY OF INVENTION

The present invention includes an apparatus for dispensing pre-packaged wine contained within an insert. The apparatus comprises a housing configured substantially in the shape of a wine barrel. The housing includes a circumferential wall, a front face fixedly connected to a first end the wall and a removable back panel attachable to an opposing second end of the wall. A shelf disposed within the housing extends from the front face toward the removable back panel. A shelf support having a semi-circular contour for engaging a lower portion of the circumferential wall is included for supporting the shelf.

The apparatus of the present invention further comprises a removable wine insert. The wine insert includes a semi-circumferential wall having a first end, a second end and opposing longitudinal edges. A semi-circular end wall affixes to the first end of the semi-circumferential wall. A semi-circular cap is securable to the second end of the semi-circumferential wall. A floor is disposed between the first end and the second end of the semi-circumferential wall. The floor includes a first portion extending from the second end along each longitudinal edge of the semi-circumferential wall and a second portion disposed between the first portion and the semi-circular end wall. The second portion positioned at an upward angle from the first portion wherein at a juncture between the second portion and the end wall the second portion is positioned apart from each longitudinal edge of the semi-circumferential wall.

A spigot for selectively dispensing wine is supported by and is positioned through the front face of the housing below the shelf. A conduit disposed within the housing below the shelf and through an aperture contained with the shelf support fluidly connects the spigot to the wine insert. The wine insert, disposable within the housing through the second end of the wall with the back panel removed, is supported by the shelf such that the wine contained within the insert is drawn by gravity down the second portion of the floor to the first portion of the floor to the fluidly connected conduit.

BRIEF DESCRIPTION OF THE DRAWINGS

The following figures are used herein in conjunction with the specification to assist in understanding the invention. The Figures are as follows.

DESCRIPTION OF THE INVENTION

Figure 1:
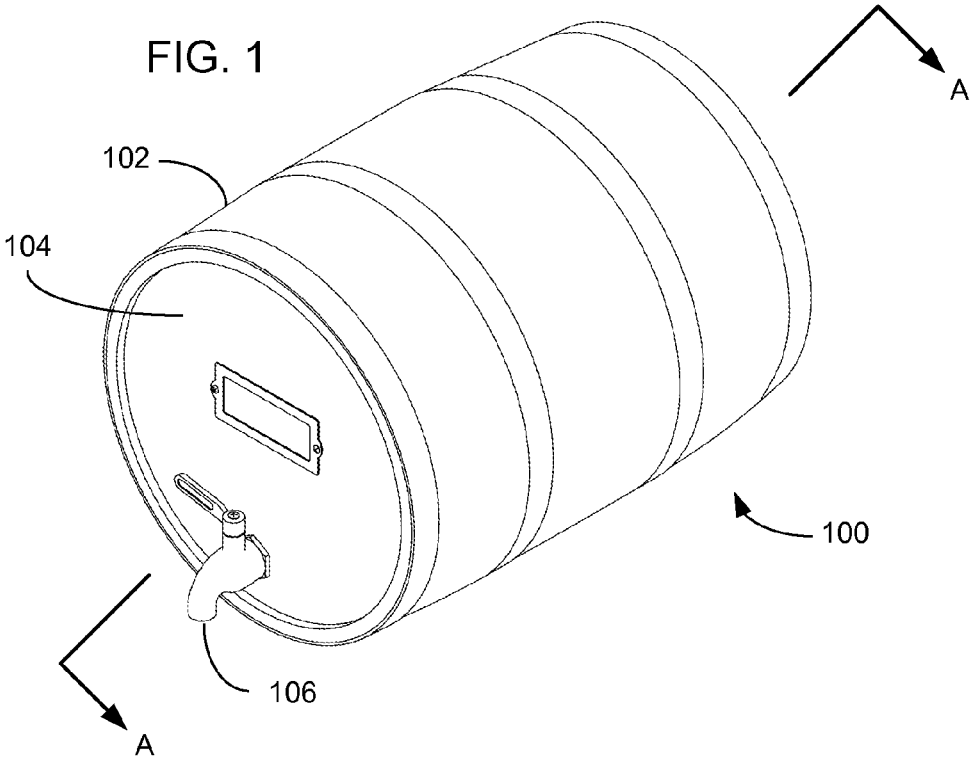
FIG. 1 is perspective view of a wine storage and dispensing apparatus in accordance with the present invention.
Figure 2:
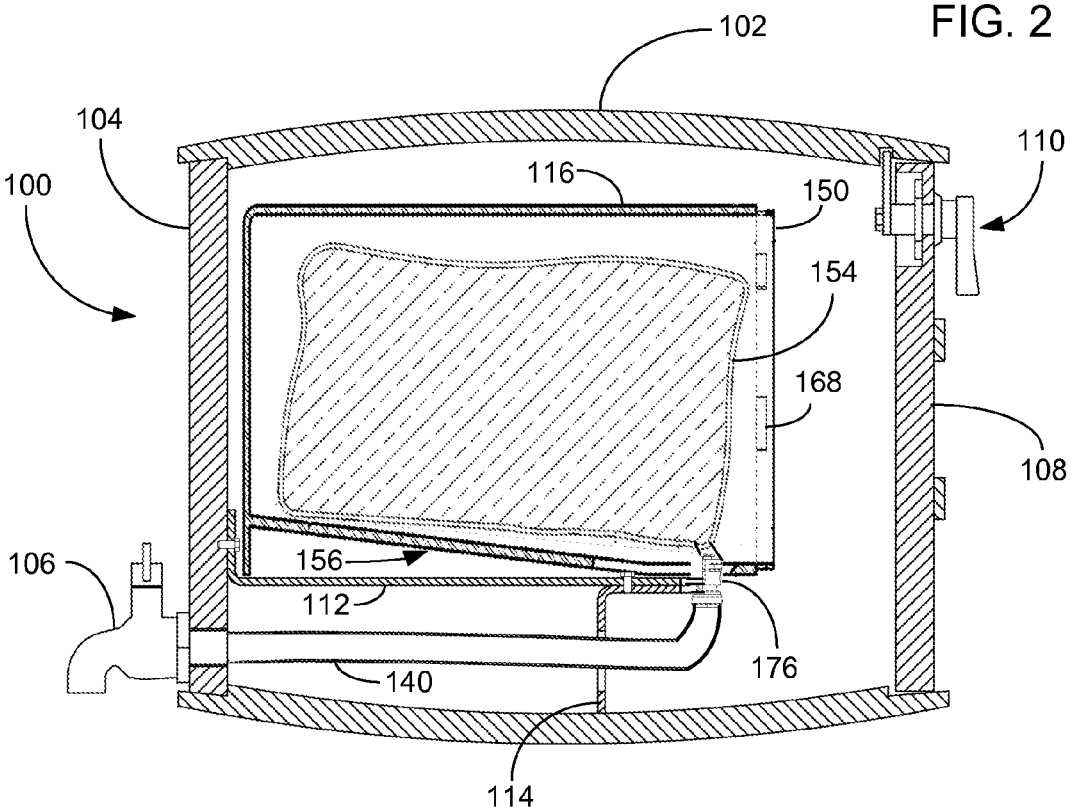
FIG. 2 is a cross-sectional view of the wine storage and dispensing apparatus of the present invention as taken along lines A-A in FIG. 1.
Figure 3:
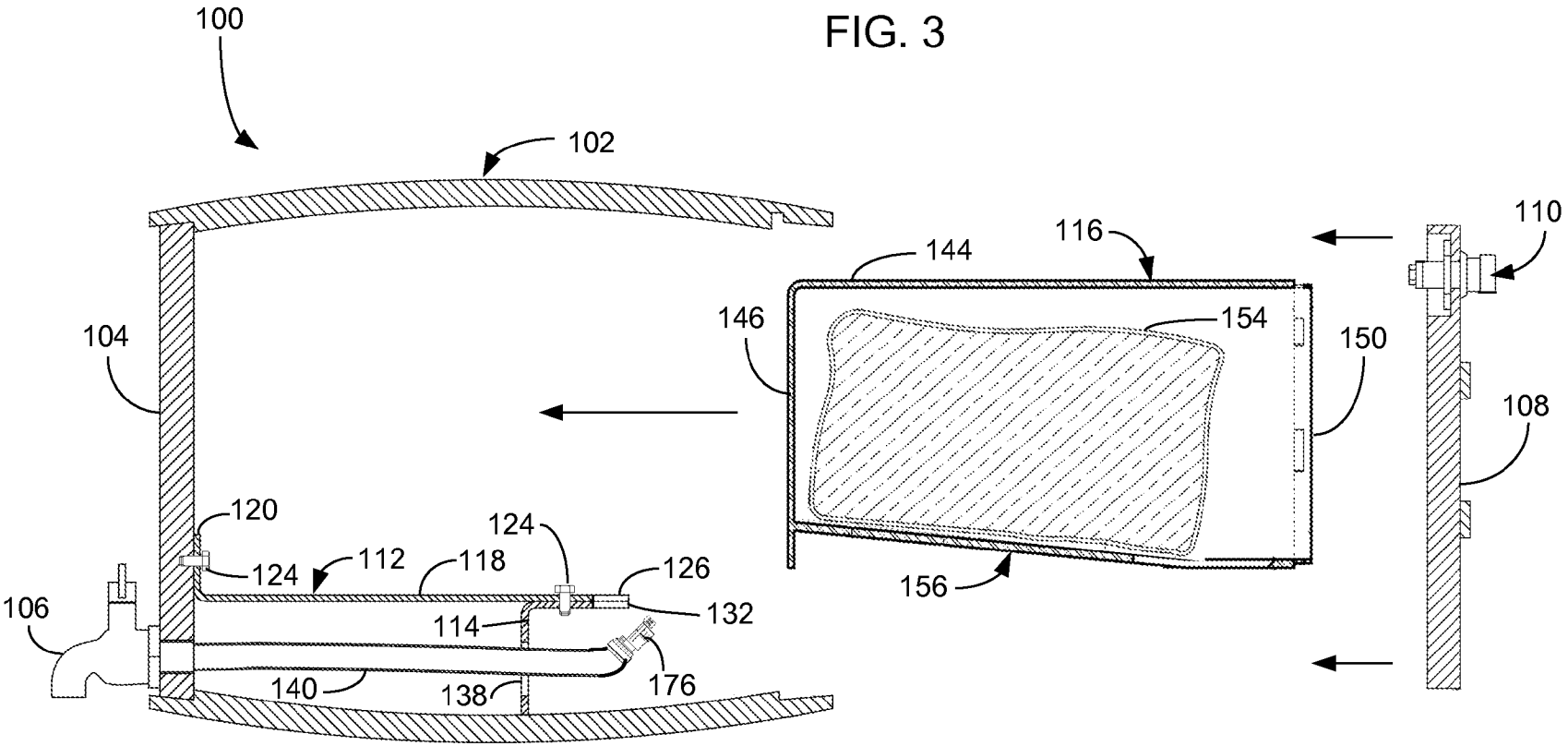
FIG. 3 is an exploded cross-sectional view of the wine storage and dispensing apparatus of the present invention.

A wine storage and dispensing apparatus in accordance with the present invention is generally indicated at 100 in FIG. 1. The apparatus 100 includes a housing structure 102, preferably an aesthetically shaped miniature wooden wine barrel, for placement on or near a bar in areas where wine would normally be dispensed. However, it should be noted that alternative shapes for the housing structure 102 are well within the scope of the present invention, including non-exhaustive examples of semi-circular barrels with flat bottoms, rectangular boxes or the like. The wine barrel 102 includes a front face 104 which supports a spout or spigot 106 for selectively dispensing wine. As illustrated in FIGS. 2 and 3, a removable back panel 108 attaches to the wine barrel 102 by means of a latching mechanism 110. The specific latching mechanism 110 employed is not critical in practicing the invention, and those skilled in the art will recognize that other mechanisms than those illustrated will suffice.

Figure 4:
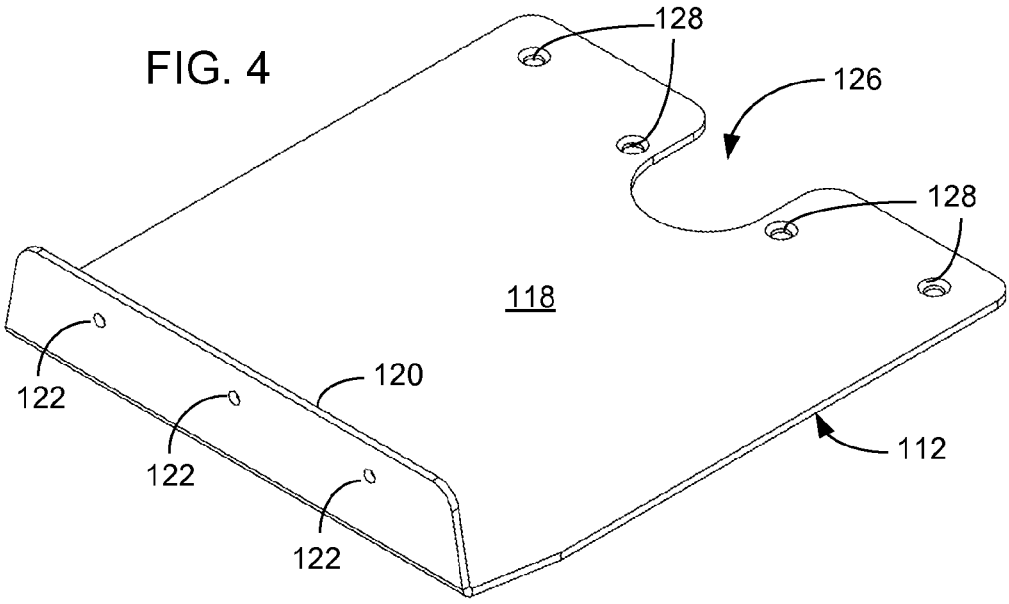
FIG. 4 is a perspective view of a shelf of the wine storage and dispensing apparatus in accordance with the present invention.
Figure 5:
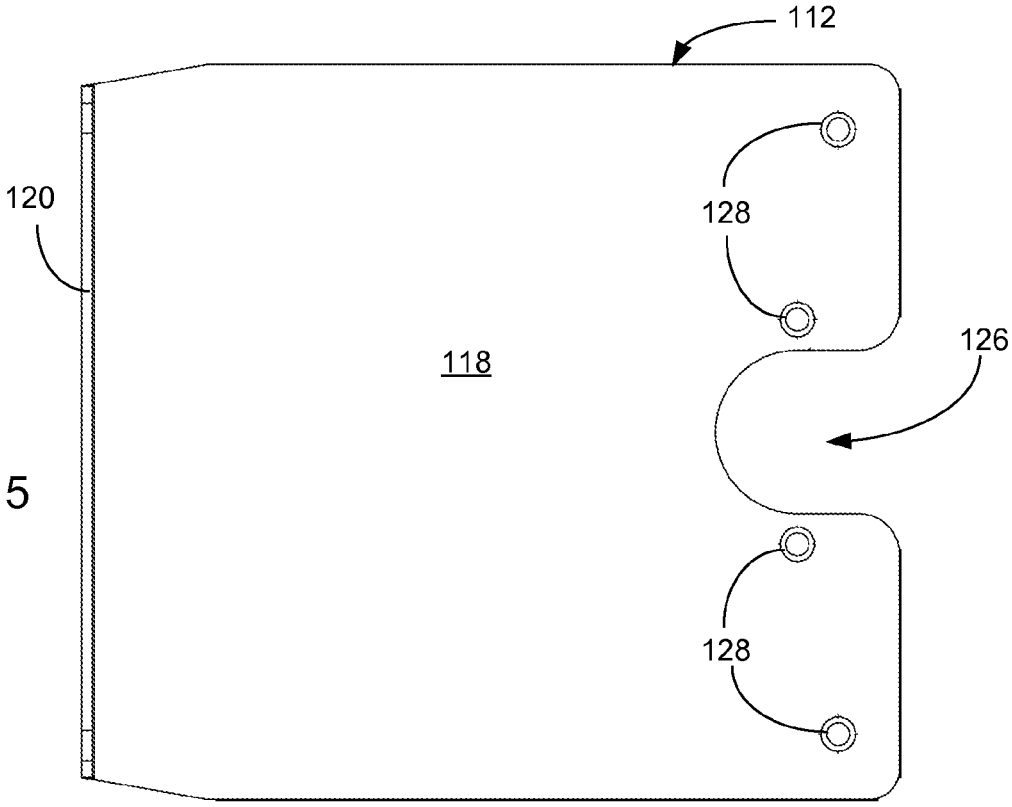
FIG. 5 is a top view of the shelf of the wine storage and dispensing apparatus in accordance with the present invention.

The apparatus 100 of the present invention further includes a shelf 112 and shelf support 114 for supporting a removable wine insert 116 positionable within the housing 102. Referring to FIGS. 4 and 5, the shelf 112 is fashioned from a durable material, preferably metal, but other durable materials are well within the scope of the present invention including, but not limited to, wood, plastic or other synthetic material. The shelf 112 includes a flat major surface 118 having a flange 120 extending therefrom on a first end. The flange 120 is abuttable against the front face 104 of the barrel 102 and contains one or more apertures 122 for securing the shelf 112 to the front face 104 by means of a fastener 124, including for example a bolt, screw or similar fastener, as is known in the art. An opposing second end of the major surface 118 contains a slot 126 to facilitate connection of the wine delivery system to the wine insert 116. The opposing end of the major surface 118 also contains one or more apertures 128 for connection to the shelf support 114.

Figure 6:
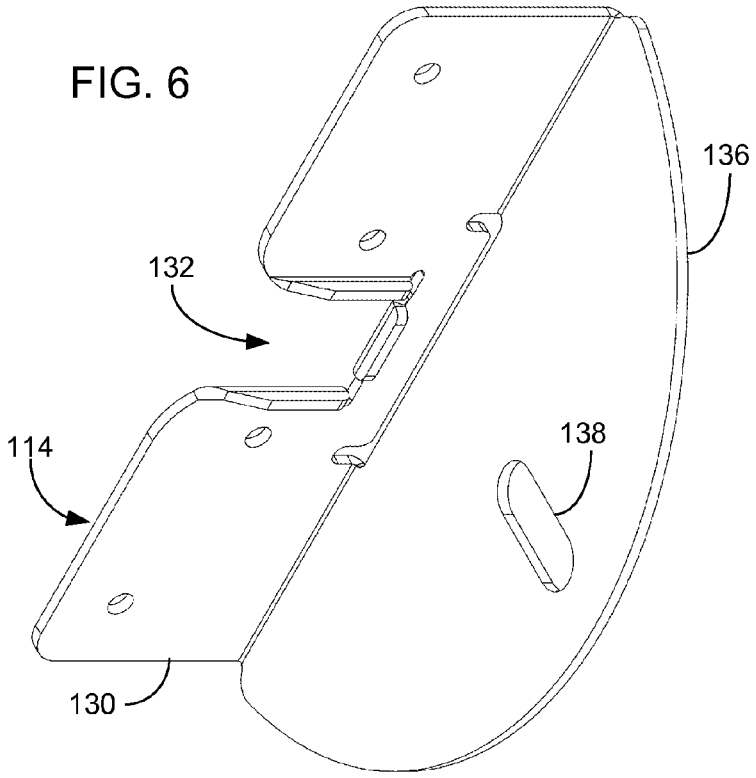
FIG. 6 is a perspective view of a shelf support of the wine storage and dispensing apparatus in accordance with the present invention.
Figure 7:
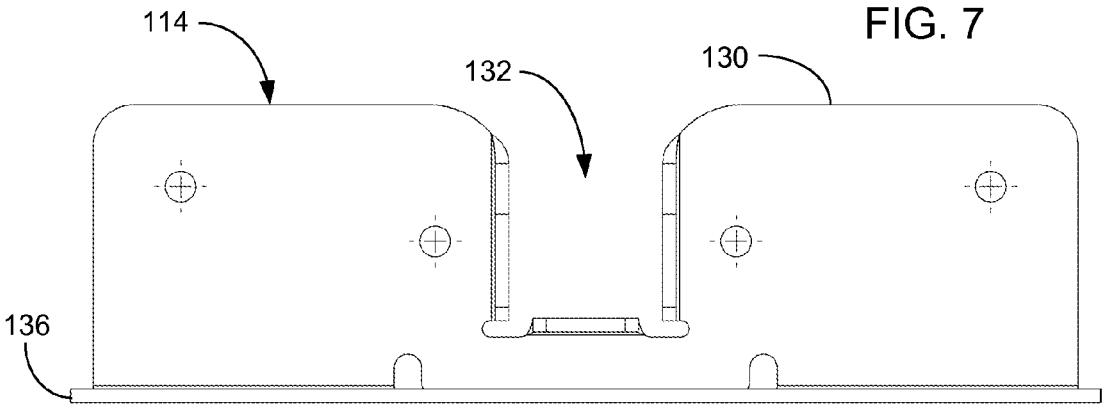
FIG. 7 is a side view of the shelf support of the wine storage and dispensing apparatus in accordance with the present invention.
Figure 8:
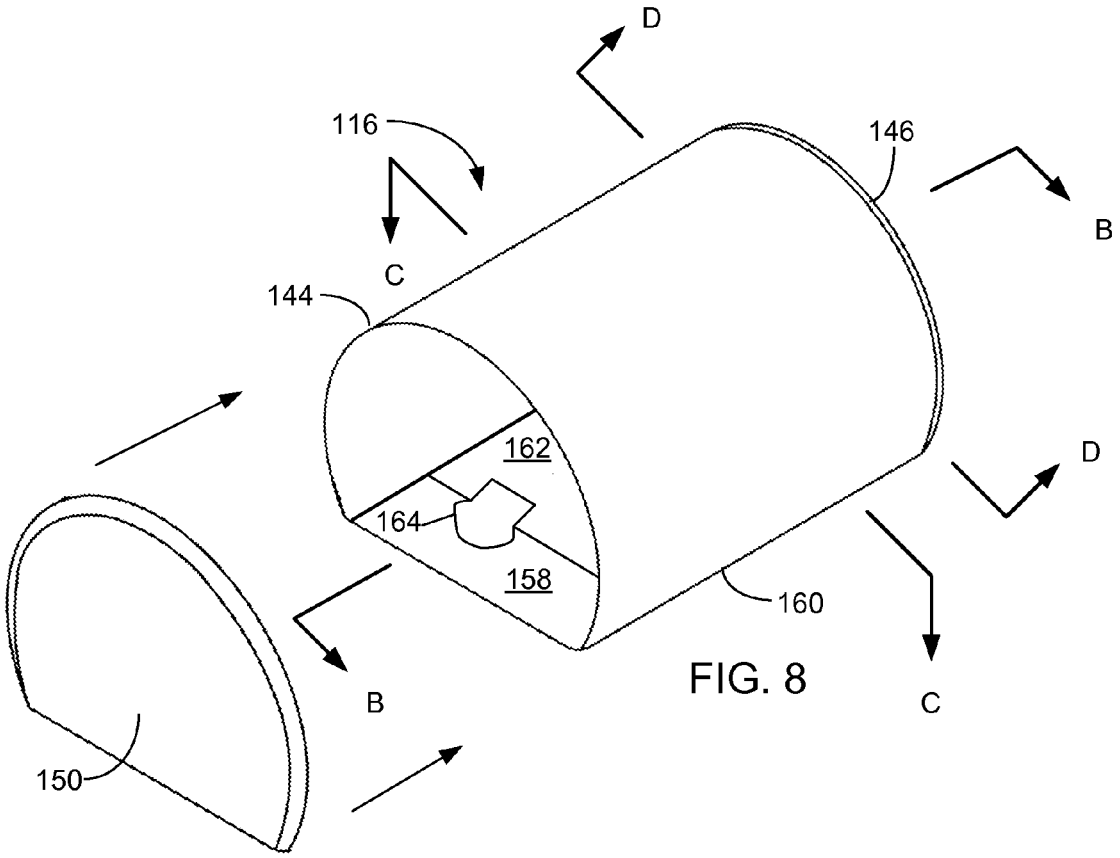
FIG. 8 is an exploded perspective view of a wine insert in accordance with the wine storage and dispensing apparatus of the present invention.

Referring to FIGS. 6 and 7, the shelf support 114 includes a generally "L"-shaped configuration with a first leg 130 mateable with an underside of the major surface 118 of the shelf 112. The first leg 130 includes a corresponding slot 132 to facilitate connection of the wine delivery system to the wine insert 116. The first leg 130 also includes corresponding apertures 134 for connecting shelf support 114 to the second end of the shelf 112, which can be accomplished by means of fasteners 134, including for example bolts, screws or similar fasteners, as is known in the art. A second leg 136 of the shelf support 114 includes a generally semi-circular configuration for cooperably engaging the lower inner surface of circumferential wall of the barrel housing 102. In this fashion, the second end of the shelf 112 rests upon and is supported by the shelf support 114 which carries the brunt of the mass of the wine insert 116. While not absolutely necessary to the practice of the present invention, it is well within the scope of the present invention to provide additional fasteners to secure the shelf to the inner circumferential wall of the housing. A slotted aperture 138 contained within the second leg 136 permits a conduit 140 of the delivery system to be disposable therethrough.

Figure 9:
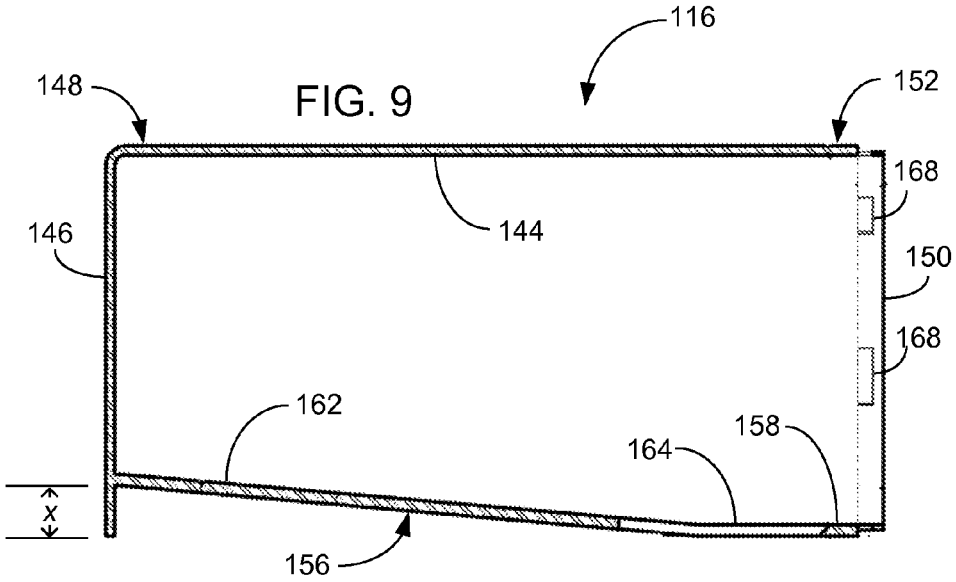
FIG. 9 is a cross-sectional view of the wine insert of the present invention as taken along lines B-B in FIG. 8.
Figure 10:
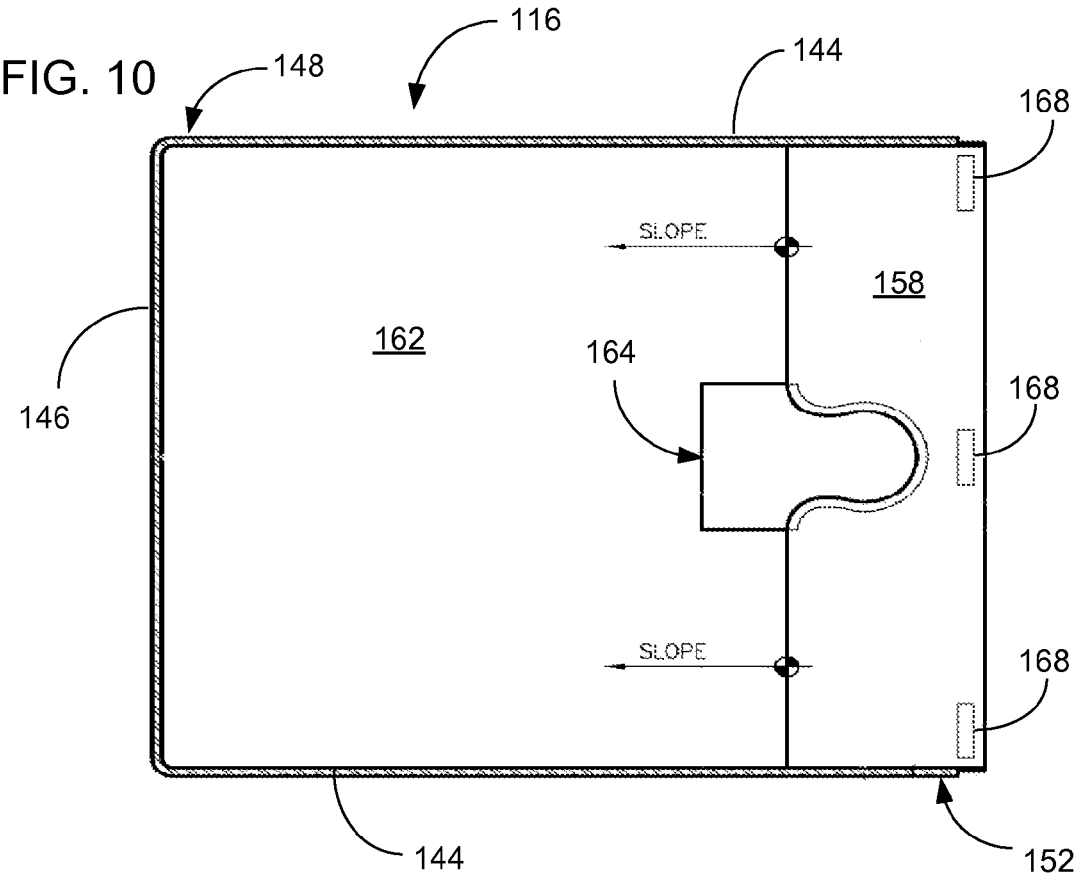
FIG. 10 is a cross-sectional view of the wine insert of the present invention as taken along lines C-C in FIG. 8.
Figure 11:
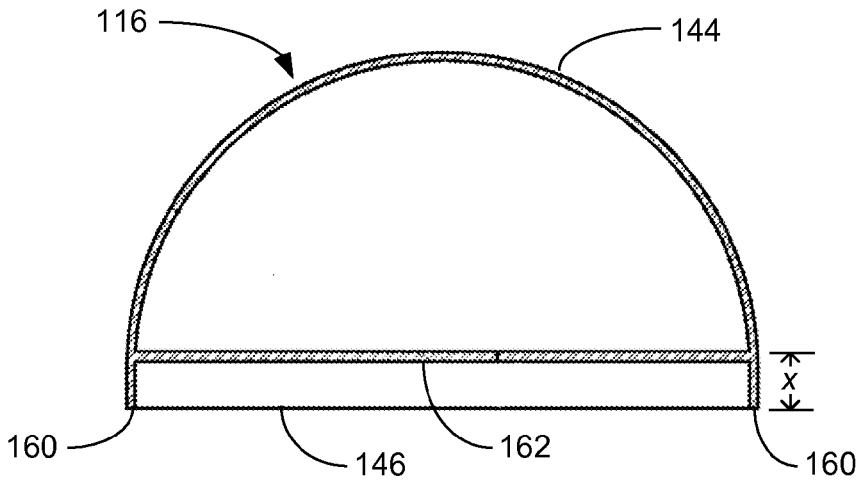
FIG. 11 is a cross-sectional view of the wine insert of the present invention as taken along lines D-D in FIG. 8.

The removable wine insert 116 is constructed from a hard durable material, preferably plastic, and includes a protruded semi-circular concave wall 144 with a semi-circular end-wall 146 secured to a first end 148. A removable cap 150 is securable to a second end 152 of semi-circular concave wall 144. The wine insert 116 houses a collapsible bladder 154, as illustrated in FIGS. 2 and 3, which is fillable with liquid, which in this case preferably includes wine. In order to facilitate gravitational draining of the contents of the bladder 154 during use, the wine insert 116 includes a sloping floor 156 disposed between opposing sides of the concaved wall 144. As best illustrated in FIGS. 9 through 11, the floor 156 includes a first portion 158 positioned proximate the second end 152 disposed substantially flat along each longitudinal edge 160 of the wall. A second portion 162 of the floor extends at an inclined angle from the first portion 158 along inner surfaces of opposing sides of the semi-circular wall 144. The second portion 162 of the floor 156 extends to and engages the end wall 146. The second portion 162 thus connects to the end wall 146 a distance x above the plane of the first portion 158. This slope allows wine contained with the bladder to be drawn by gravity to an exit portal 164 contained within both the first and second portions of the floor 156.

Figure 12:
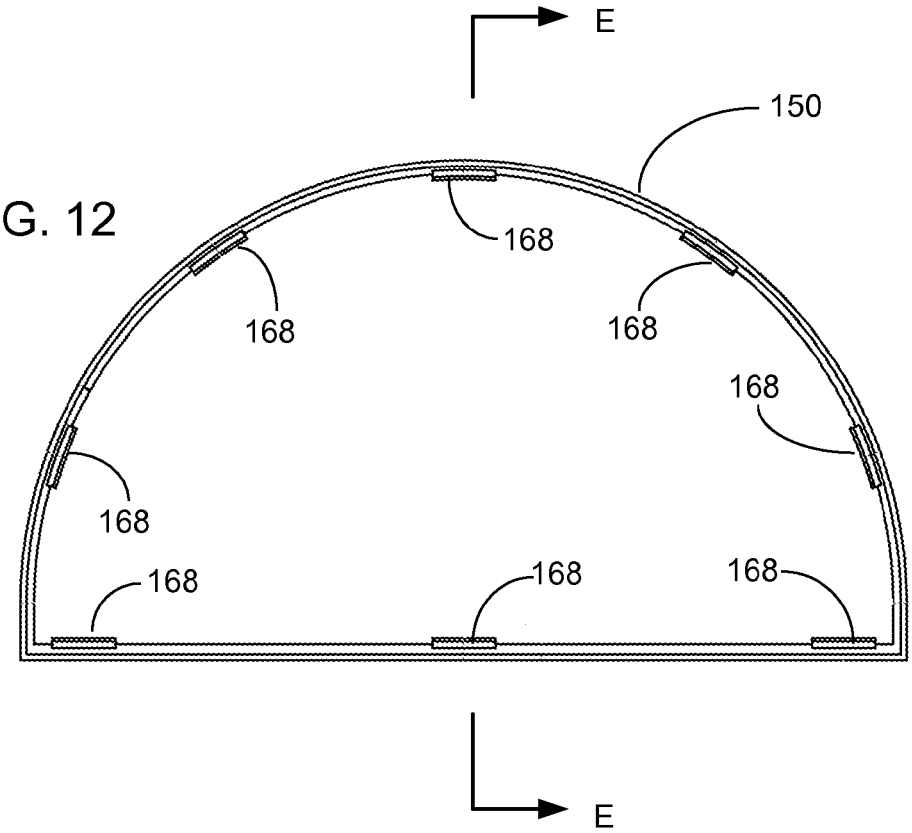
FIG. 12 is a side-view of a cover of the wine insert in accordance with the wine storage and dispensing apparatus of the present invention.
Figure 13:
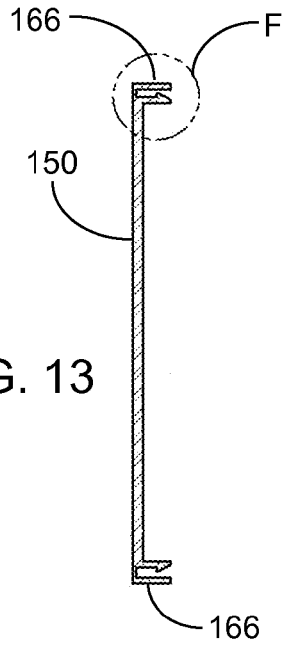
FIG. 13 is a cross-sectional view of the cover of the wine insert as taken along lines E-E in FIG. 12.
Figure 14:
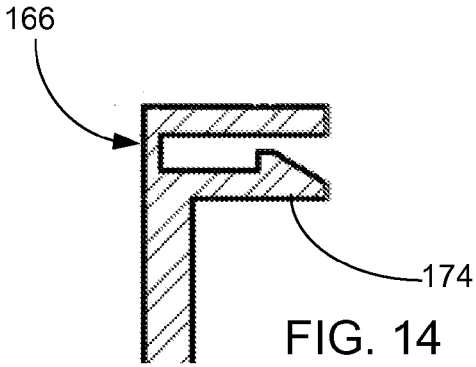
FIG. 14 is an enlarged cross-sectional view of the cover of the wine insert as taken from portal F in FIG. 13.

Referring now to FIGS. 12 through 14, the removable cap member 150 is provided to enclose the wine insert 116. The cap member 150 is also constructed from a hard durable material, preferably plastic, and is attachably removable to the second end 152 of the circumferential wall 144 as well as to the first portion 158 of the floor 156. For attaching the cap member 150, attaching portions 166 are provided which are insertable into corresponding receiving ports 168 contained within the circumferential wall 144 and the first portion 158 of the floor 156. Each port 168 is receivable by respective attaching portions 166. Each attaching portion 166 includes a resilient tab 172 which allows the respective insertion member 170 to pass thereover and then lock in place. The resiliency of the tab 172 is such that the cap member 150 remains secured to the wine insert during normal use, but can be pried and removed when replacing the bladder 154.

As is known in the art, the bladder 154 may is constructed of a flexible material such that it may collapse upon itself when the contents therein are drained. Such materials can include metallic sheeting or plastic formed to provide a hermetically sealed interior. To fill the bladder, all air is first evacuated after which the wine is introduced therein. Upon being filled, the bladder is injected with an overpressure of an inert gas, such as Argon, to prevent oxygenation of the wine and thereby extend shelf life. Further, by filling the bladder with an inert gas, it has been discovered that the wine can remain unspoiled after opening for a much longer time than is observed within conventional wine-in-a-box methods. Instead of less than two weeks, which is typical for a conventional device, the wind dispensing apparatus of the present invention can prevent oxygenation and spoiling of the wine after opening for up to eight weeks.

It is intended that either the vintner or the wine wholesaler fills the bladders with wine, along with the overpressure of inert gas prior to sealing the bladder within the insert. The insert thereby provides a protecting structure to prevent the bladder from being punctured during transit or use. The vintner or wholesaler then ships the insert, or a plurality of inserts, directly to the restaurant when they can be stored until needed for dispensing.

To transfer the wine contained within the bladder positioned within the insert, a liquid transfer mechanism is provided. Referring back to FIGS. 1 through 3, the liquid transfer mechanism includes the spigot 106 in fluid communication with the conduit 140, which in turn fluidly connects to a quick connector 176. The conduit may consist of a flexible hose, or may be a telescoping conduit similar to that as fully described in U.S. Pat. No. 8,596,496, the entirety of which is incorporated herein by reference.

The quick connect is preferably a VITOP® BAG-IN-BOX® quick connect as made available by the Smurfit Kappa Group of Eperny, France. As is known in the art, the quick connect includes a male and female connector and any variety of connectors are well within the scope of the present invention.

The apparatus 100 further includes an optional thermoelectric heat pump and insulation (neither shown) for cooling wine contained within the barrel 102. The thermoelectric heat pump and insulation are fully disclosed in commonly owned U.S. Pat. No. 8,596,496.

In operation, the apparatus 100 containing an insert with wine contained therein is positioned within a restaurant, home or other suitable place where it is convenient to dispense the wine into individual glasses when so desired. Upon depleting the contents of the bladder, whereby the wine insert 116 needs to be replenished, the back cover 108 of the housing 102 is removed. The user disconnects and pulls the insert 116 from the housing 102. A new insert containing a full bladder of wine is then disposed within the barrel 102. The connector 176 is attached to the insert 116 and the back cover 108 is replaced. The apparatus 100 is then ready again to dispense the wine through the spigot 106, and the wine within the insert is storable for up to 8 weeks.

Although the present invention has been described with reference to preferred embodiments, workers skilled in the art will recognize that changes may be made in form and detail without departing from the spirit and scope of the invention.

The invention claimed is:

1. An apparatus for storing and dispensing pre-packaged wine, the apparatus comprising:

a housing configured substantially in the shape of a wine barrel, the housing including a circumferential wall, a front face fixedly connected to a first end of the circumferential wall, and a removable back panel attachable to an opposing second end of the circumferential wall;

a shelf disposed within the housing for supporting a wine insert, the shelf having a proximal portion extending substantially perpendicular from the front face and a distal portion terminating proximate to the removable back panel;

a shelf support including a first portion having a semi-circular contour for engaging the circumferential wall and a second portion positioned perpendicular to the first portion, the second portion attachable to the distal portion of the shelf;

a spigot for selectively dispensing wine, the spigot supported by and positioned through the front face of the housing below the shelf; and a conduit positioned within the housing below the shelf, the conduit connected to the spigot and extending through an aperture contained within the first portion of the shelf support, wherein the wine insert containing the pre-packaged wine is disposable within the housing through the second end of the wall with the back panel removed, the insert supported by the shelf.

2. The apparatus of claim 1 wherein the wine insert comprises:

a concave wall;

a floor having a first portion extending along peripheral surfaces of the concave wall and a second portion extending along inner surfaces of the concave wall, the second portion extending from the first portion at an angle, the first and second portions containing surfaces defining a port;

a semi-circular end-wall connected to a distal end of the concave wall and the second portion of the floor;

a removable cap securable to a proximal end of the concave wall and the first portion of the floor, wherein wine contained within a collapsible bladder contained within the wine insert is drawn by gravity down the second portion of the floor to the first portion of the floor.

3. The apparatus of claim 2 wherein the floor causes the wine contained within the insert to be urged toward the back panel of the housing.

4. An apparatus for dispensing pre-packaged wine, the wine containable within an insert, the apparatus comprising:

a housing configured substantially in the shape of a wine barrel, the housing including:

a circumferential wall;

a front face fixedly connected to a first end of the wall; and a removable back panel attachable to an opposing second end of the wall;

a shelf extending from the front face toward the removable back panel;

a shelf support for supporting the shelf, the shelf support including a semi-circular contour for engaging a lower portion of the circumferential wall;

a spigot for selectively dispensing wine, the spigot supported by and positioned through the front face of the housing below the shelf;

a conduit positioned within the housing below the shelf, the conduit connected to the spigot and disposable through an aperture contained within the shelf support; and a removable wine insert, the wine insert including:

a semi-circumferential wall having a first end, a second end and opposing longitudinal edges;

a semi-circular end wall affixed to the first end of the semi-circumferential wall;

a semi-circular cap securable to the second end of the semi-circumferential wall;

a floor disposed between the first end and the second end of the semi-circumferential wall, the floor including:

a first portion extending from the second end along each longitudinal edge of the semi-circumferential wall; and a second portion disposed between the first portion and the semi-circular end wall, the second portion positioned at an upward angle from the first portion wherein at a juncture between the second portion and the end wall the second portion is positioned apart from each longitudinal edge of the semi-circumferential wall;

wherein the wine insert is disposable within the housing through the second end of the wall with the back panel removed, the wine insert supportable by the shelf, wherein the conduit is fluidly connectable to the wine insert proximate the second end of the wall, wherein wine contained within a collapsible bladder positioned within the wine insert is drawn by gravity down the second portion of the floor toward the first portion of the floor to the fluidly connected conduit.

* * * * *